US008287110B2

(12) United States Patent
Nozawa

(10) Patent No.: US 8,287,110 B2
(45) Date of Patent: Oct. 16, 2012

(54) PACKED LIQUID CONTAINER AND LIQUID CONTAINER THEREOF

(75) Inventor: Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

(21) Appl. No.: 12/534,634

(22) Filed: Aug. 3, 2009

(65) Prior Publication Data

US 2010/0033544 A1 Feb. 11, 2010

(30) Foreign Application Priority Data

Aug. 5, 2008 (JP) ..... 2008-202078

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 5,701,995 | A * | 12/1997 | Higuma et al. | 206/205 |
| 6,241,348 | B1 * | 6/2001 | Haigo | 347/86 |
| 6,276,786 | B1 * | 8/2001 | Eida et al. | 347/86 |
| 6,755,515 | B2 | 6/2004 | Usui et al. | 347/86 |
| 6,793,330 | B2 | 9/2004 | Usui et al. | 347/86 |
| 2001/0017640 | A1 * | 8/2001 | Inada et al. | 347/84 |
| 2002/0109759 | A1 | 8/2002 | Usui et al. | 347/86 |
| 2002/0140788 | A1 | 10/2002 | Usui et al. | 347/86 |
| 2003/0071881 | A1 * | 4/2003 | Toba et al. | 347/86 |
| 2003/0174192 | A1 * | 9/2003 | Nanjo | 347/86 |
| 2005/0134663 | A1 * | 6/2005 | Sasaki et al. | 347/86 |
| 2006/0215002 | A1 * | 9/2006 | Ishizawa et al. | 347/86 |
| 2008/0036834 | A1 | 2/2008 | Usui et al. | 347/86 |

FOREIGN PATENT DOCUMENTS

| | | | |
|---|---|---|---|
| JP | 2000-033709 | | 2/2000 |
| JP | 2004-243758 | | 9/2004 |
| JP | 2008-044199 | | 2/2008 |
| JP | 2008105727 | A * | 5/2008 |

* cited by examiner

*Primary Examiner* — Shelby Fidler

(57) ABSTRACT

A liquid container is mounted on a liquid ejecting apparatus when being used. The liquid container includes a plurality of outer surfaces, a liquid supply section that is connected to the liquid ejecting apparatus, a liquid storage chamber that is disposed on the upstream side of the liquid supply section and stores liquid, and an atmosphere introducing section that is disposed in the liquid storage chamber and introduces atmosphere into the liquid storage chamber from the outside through an atmosphere opening port as the liquid stored in the liquid storage chamber is consumed. The atmosphere opening port is exposed to a first outer surface that has the largest area among the plurality of outer surfaces.

11 Claims, 13 Drawing Sheets

CROSS SECTION TAKEN ALONG LINE IXA—IXA

CROSS SECTION TAKEN ALONG LINE IXA – IXA

PACKED LIQUID CONTAINER AND LIQUID CONTAINER THEREOF

BACKGROUND

1. Technical Field

The present invention relates to a liquid container, a packed liquid container, and a method of manufacturing the packed liquid container.

2. Related Art

An ink jet printer has been known as an example of a liquid ejecting apparatus. In the ink jet printer, ink is supplied from an ink cartridge. In the past, there has been known an ink cartridge that includes an ink supply hole on the downstream side and an atmosphere opening port provided on the upstream side. The ink supply hole can be connected to the ink jet printer, and the atmosphere is introduced into the cartridge through the atmosphere opening port (for example, JP-A-2008-44199, JP-A-2004-243758, and JP-A-2000-33709). As the ink in this ink cartridge is consumed, the atmosphere is introduced into the cartridge through the atmosphere opening port.

When this atmosphere communication type ink cartridge is used, the atmosphere opening port needs to be opened and the ink storage chamber provided in the cartridge needs to communicate with the atmosphere. Meanwhile, when the ink cartridge is transported or is on sale before being used, it is preferable that the atmosphere opening port be sealed and closed by a sealing member or a valve in order to prevent the transmutation of ink.

SUMMARY

An advantage of some aspects of the invention is to provide a technique that improves the reliability of the seal of an atmosphere opening port when the ink cartridge is transported or on sale before being used.

The invention may be achieved as the following embodiments or application examples.

According to a first aspect of the invention, there is provided a liquid container that is mounted on a liquid ejecting apparatus when being used, the liquid container including: a plurality of outer surfaces; a liquid supply section that is connected to the liquid ejecting apparatus; a liquid storage chamber that is disposed on the upstream side of the liquid supply section and stores liquid; and an atmosphere introducing section that is disposed in the liquid storage chamber, and introduces atmosphere into the liquid storage chamber from the outside through an atmosphere opening port as the liquid stored in the liquid storage chamber is consumed, wherein the atmosphere opening port is exposed to a first outer surface that has the largest area among the plurality of outer surfaces.

When the liquid container is packed by the packing member under decompression, the pressing force, which is applied to the packing member from the outside due to the atmospheric pressure, is larger on the outer surface having a large area in comparison with on the outer surface having a small area. Accordingly, if the atmosphere opening port is formed at the first outer surface having the largest area among the outer surfaces of the ink cartridge as described above, it may be possible to improve the reliability of the seal of the atmosphere opening port.

According to a second aspect of the invention, in the liquid container according to the first aspect, the liquid container is packed by a packing member, an inner space of the packing member is decompressed, and a gap between an inner surface of the packing member and the atmosphere opening port is sealed by a pressing force that is applied to the packing member from the outside due to the atmospheric pressure, so that the atmosphere opening port is closed.

Accordingly, it may be possible to stably seal the atmosphere opening port by using the pressing force of the packing member that applied to the first outer surface having the largest area.

According to a third aspect of the invention, in the liquid container according to the second aspect, a valve for opening and closing the atmosphere opening port is not provided at the atmosphere opening port, and a sealing member for blocking the atmosphere opening port is not provided at the atmosphere opening port.

Accordingly, if a user opens the packing, the liquid storage chamber communicates with the atmosphere through the atmosphere opening port, so that it may be possible to use the liquid container. That is, a user does not need to remove a sealing member, such as a releasable film or plug, so that convenience is improved. There is no concern that a user might forget to remove the sealing member. Further, since it is not necessary to provide a component, such as a valve or a sealing member, it may be possible to reduce the number of components or the manufacturing cost. In addition, since a valve is not provided, it is not necessary to provide the structure required for opening the valve when the container is mounted on the liquid ejecting apparatus. Accordingly, it may be possible to reduce the manufacturing cost or the number of components of the liquid ejecting apparatus as well as the manufacturing cost or the number of components of the liquid container.

According to a fourth aspect of the invention, in the liquid container according to any one of the first to third aspect, an outer edge portion of the atmosphere opening port protrudes outward from the first outer surface.

Accordingly, the pressing force, which is applied to the packing member from the outside due to the atmospheric pressure, is applied substantially to the entire first outer surface and is further concentrated on the protruding portion. Therefore, it may be possible to more reliably seal the atmosphere opening port.

According to a fifth aspect of the invention, in the liquid container according to any one of the first to third aspect, a sealing member, which protrudes outward from the first outer surface, is provided at the outer edge portion of the atmosphere opening port.

Accordingly, the pressing force, which is applied to the packing member from the outside due to the atmospheric pressure, is applied substantially to the entire first outer surface and is further concentrated on the protruding portion. Therefore, it may be possible to more reliably seal the atmosphere opening port. In particular, if the sealing member has elasticity, the sealing member and the packing member are in close contact with each other, so that the sealing performance of the outer edge portion of the atmosphere opening port is improved.

According to a sixth aspect of the invention, in the liquid container according to the fifth aspect, the liquid container further includes: a case where at least a part of the atmosphere introducing section, at least a part of the liquid storage chamber, and the liquid supply section are formed, wherein the sealing member is integrally formed with the case.

Accordingly, it may be possible to decrease the difference between the positions of an inlet of the atmosphere introducing section that is provided in the case and the sealing member of which the end forms the atmosphere opening port. Therefore, it may be possible to more reliably seal the atmosphere opening port.

According to a seventh aspect of the invention, in the liquid container according to the sixth aspect, the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface. One end of the first communication passage is connected to the atmosphere opening port and the other end thereof is connected to the second flow passage, one end of the second communication passage is connected to the first flow passage and the other end thereof is connected to the second flow passage, and an opening of the first flow passage facing the first outer surface and an opening of the second flow passage facing the second outer surface are sealed by a film.

Accordingly, it may be possible to easily form the inlet of the atmosphere introducing section, of which the outer edge portion does not have any voids, on the first outer surface of the case. Further, since the inlet of the atmosphere introducing section has a shape without voids, it may be possible to seal the entire outer edge portion of the inlet of the atmosphere introducing section by the sealing member. Therefore, it may be possible to more reliably seal the atmosphere opening port.

According to an eighth aspect of the invention, in the liquid container according to any one of the first to fifth aspect, the liquid container further includes: a case where at least a part of the atmosphere introducing section, at least a part of the liquid storage chamber, and the liquid supply section are formed, wherein the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface. One end of the first communication passage is connected to the atmosphere opening port and the other end thereof is connected to the second flow passage, one end of the second communication passage is connected to the first flow passage and the other end thereof is connected to the second flow passage, and an opening of the first flow passage facing the first outer surface and an opening of the second flow passage facing the second outer surface are sealed by a film.

Accordingly, it may be possible to easily form the atmosphere opening port, of which the outer edge portion does not have any voids, on the first outer surface of the case. Further, since the protruding portion has a shape without voids, it may be possible to seal the entire outer edge portion of the atmosphere opening port by the inner surface of the sealing member. Therefore, it may be possible to more reliably seal the atmosphere opening port.

According to a ninth aspect of the invention, there is provided a packed liquid container including a container that is mounted on a liquid ejecting apparatus when being used and a packing member that packs the container, wherein the container includes a plurality of outer surfaces, a liquid supply section that is connected to the liquid ejecting apparatus, a liquid storage chamber that is disposed on the upstream side of the liquid supply section and stores liquid, and an atmosphere introducing section that is disposed in the liquid storage chamber and introduces atmosphere into the liquid storage chamber from the outside through an atmosphere opening port as the liquid stored in the liquid storage chamber is consumed. The atmosphere opening port is exposed to a first outer surface among the plurality of outer surfaces, an inner space of the packing member is decompressed, and a gap between an inner surface of the packing member and the atmosphere opening port is sealed by a pressing force that is applied to the packing member from the outside due to the atmospheric pressure, so that the atmosphere opening port is closed.

Accordingly, it may be possible to stably seal the atmosphere opening port by using the pressing force that is applied to the packing member from the outside due to the atmospheric pressure.

According to a tenth aspect of the invention, in the packed liquid container according to the ninth aspect, a valve for opening and closing the atmosphere opening port is not provided at the atmosphere opening port, and a sealing member for blocking the atmosphere opening port is not provided at the atmosphere opening port.

Accordingly, if a user opens the packing, the liquid storage chamber communicates with the atmosphere through the atmosphere opening port, so that it may be possible to use the liquid container. That is, a user does not need to remove a sealing member, such as a releasable film or plug, so that convenience is improved. There is no concern that a user may forget to remove the sealing member. Further, since it is not necessary to provide a component, such as a valve or a sealing member, it may be possible to reduce the number of components or the manufacturing cost. In addition, since a valve is not provided, it is not necessary to provide the structure required for opening the valve when the container is mounted on the liquid ejecting apparatus. Accordingly, it may be possible to reduce the manufacturing cost or the number of components of the liquid ejecting apparatus as well as the manufacturing cost or the number of components of the liquid container.

According to an eleventh aspect of the invention, in the packed liquid container according to any one of the ninth or tenth aspect, an outer edge portion of the atmosphere opening port protrudes outward from the first outer surface.

Accordingly, the pressing force, which is applied to the packing member from the outside due to the atmospheric pressure, is applied substantially to the entire first outer surface and is further concentrated on the protruding portion. Therefore, it may be possible to more reliably seal the atmosphere opening port.

According to a twelfth aspect of the invention, in the packed liquid container according to any one of the ninth or tenth aspect, a sealing member, which protrudes outward from the first outer surface, is provided at the outer edge portion of the atmosphere opening port.

Accordingly, the pressing force, which is applied to the packing member from the outside due to the atmospheric pressure, is applied substantially to the entire first outer surface and is further concentrated on the protruding portion. Therefore, it may be possible to more reliably seal the atmosphere opening port. In particular, if the sealing member has elasticity, the sealing member and the packing member are in close contact with each other, so that the sealing performance of the outer edge portion of the atmosphere opening port is improved.

According to a thirteenth aspect of the invention, in the packed liquid container according to the twelfth aspect, the packed liquid container further includes: a case where at least a part of the atmosphere introducing section, at least a part of the liquid storage chamber, and the liquid supply section are formed, wherein the sealing member is integrally formed with the case.

Accordingly, it may be possible to decrease the difference between the positions of an inlet of the atmosphere introducing section that is provided in the case and the sealing member of which the end forms the atmosphere opening port. Therefore, it may be possible to more reliably seal the atmosphere opening port.

According to a fourteenth aspect of the invention, in the packed liquid container according to the thirteenth aspect, the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface. One end of the first communication passage is connected to the atmosphere opening port and the other end thereof is connected to the second flow passage, one end of the second communication passage is connected to the first flow passage and the other end thereof is connected to the second flow passage, and an opening of the first flow passage facing the first outer surface and an opening of the second flow passage facing the second outer surface are sealed by a film.

Accordingly, it may be possible to easily form the inlet of the atmosphere introducing section, of which the outer edge portion does not have any voids, on the first outer surface of the case. Further, since the inlet of the atmosphere introducing section has a shape without voids, it may be possible to seal the entire outer edge portion of the inlet of the atmosphere introducing section by the sealing member. Therefore, it may be possible to more reliably seal the atmosphere opening port.

According to a fifteenth aspect of the invention, in the packed liquid container according to any one of the ninth to twelfth aspect, the packed liquid container further includes: a case where at least a part of the atmosphere introducing section, at least a part of the liquid storage chamber, and the liquid supply section are formed, wherein the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface. One end of the first communication passage is connected to the atmosphere opening port and the other end thereof is connected to the second flow passage, one end of the second communication passage is connected to the first flow passage and the other end thereof is connected to the second flow passage, and an opening of the first flow passage facing the first outer surface and an opening of the second flow passage facing the second outer surface are sealed by a film.

Accordingly, it may be possible to easily form the atmosphere opening port, of which the outer edge portion does not have any voids, on the first outer surface of the case. Further, since the protruding portion has a shape without voids, it may be possible to seal the entire outer edge portion of the atmosphere opening port by the inner surface of the sealing member. Therefore, it may be possible to more reliably seal the atmosphere opening port.

According to a sixteenth aspect of the invention, there is provided a method of manufacturing a packed liquid container that includes a container and a packing member for packing the container, the container including a plurality of outer surfaces, a liquid supply section that is connected to the liquid ejecting apparatus, a liquid storage chamber that is disposed on the upstream side of the liquid supply section and stores liquid, and an atmosphere introducing section that is disposed in the liquid storage chamber and introduces atmosphere into the liquid storage chamber from the outside through an atmosphere opening port as the liquid stored in the liquid storage chamber is consumed, the atmosphere opening port being exposed to a first outer surface among the plurality of outer surfaces, the method including: preparing the container; preparing the packing member for packing the container; packing the container by the packing member under decompression; and sealing a gap between an inner surface of the packing member and the atmosphere opening port by a pressing force, which is applied to the packing member from the outside due to the atmospheric pressure, by transferring the container, which is packed by the packing member, to the atmosphere.

Accordingly, it may be possible to stably seal the atmosphere opening port by using the pressing force that is applied to the packing member from the outside due to the atmospheric pressure.

Meanwhile, the invention may be achieved in various forms, for example, may be achieved in the form of a method of packing a liquid container, a method of sealing a liquid container, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described.

A. First Embodiment

Figure 1:
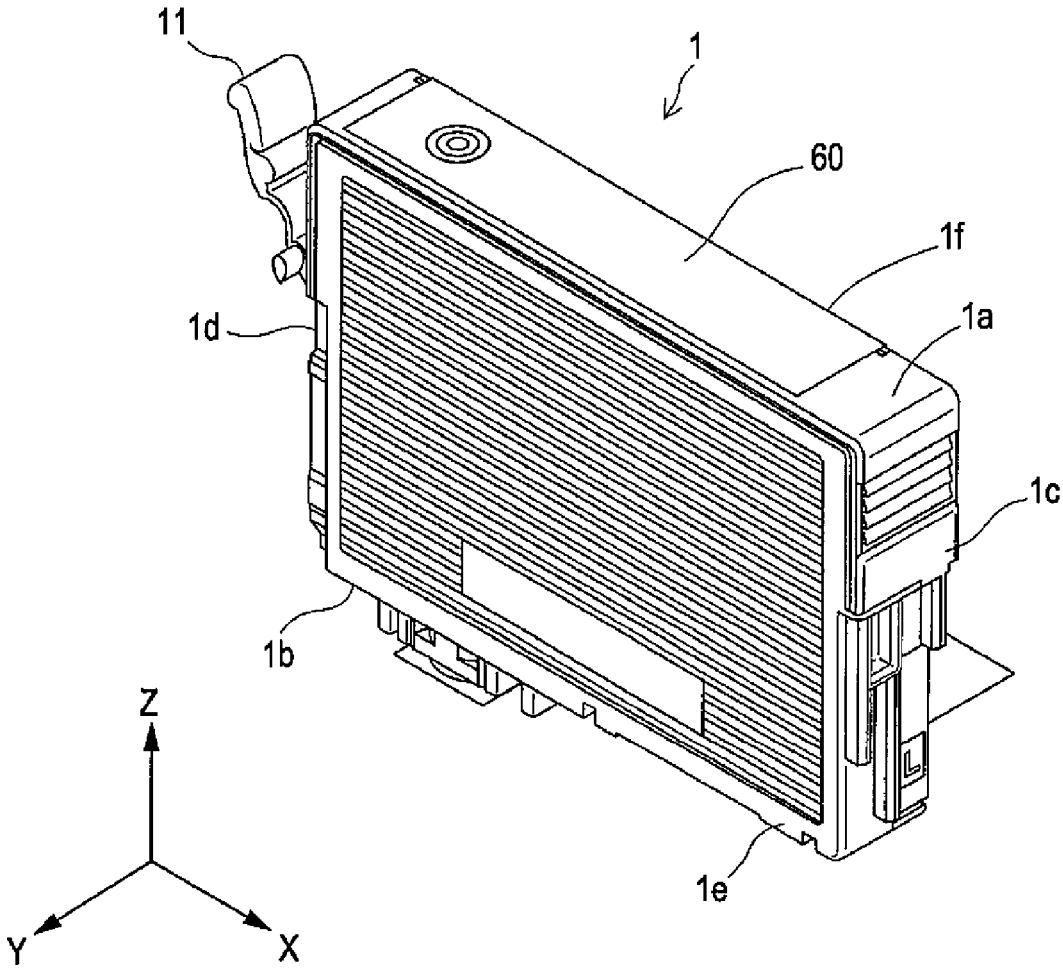
FIG. 1 is a first perspective view showing the appearance of an ink cartridge according to an embodiment of the invention.

Schematic Structure of Ink Cartridge:

FIG. 1 is a first perspective view showing the appearance of an ink cartridge according to an embodiment of the invention.

Figure 2:
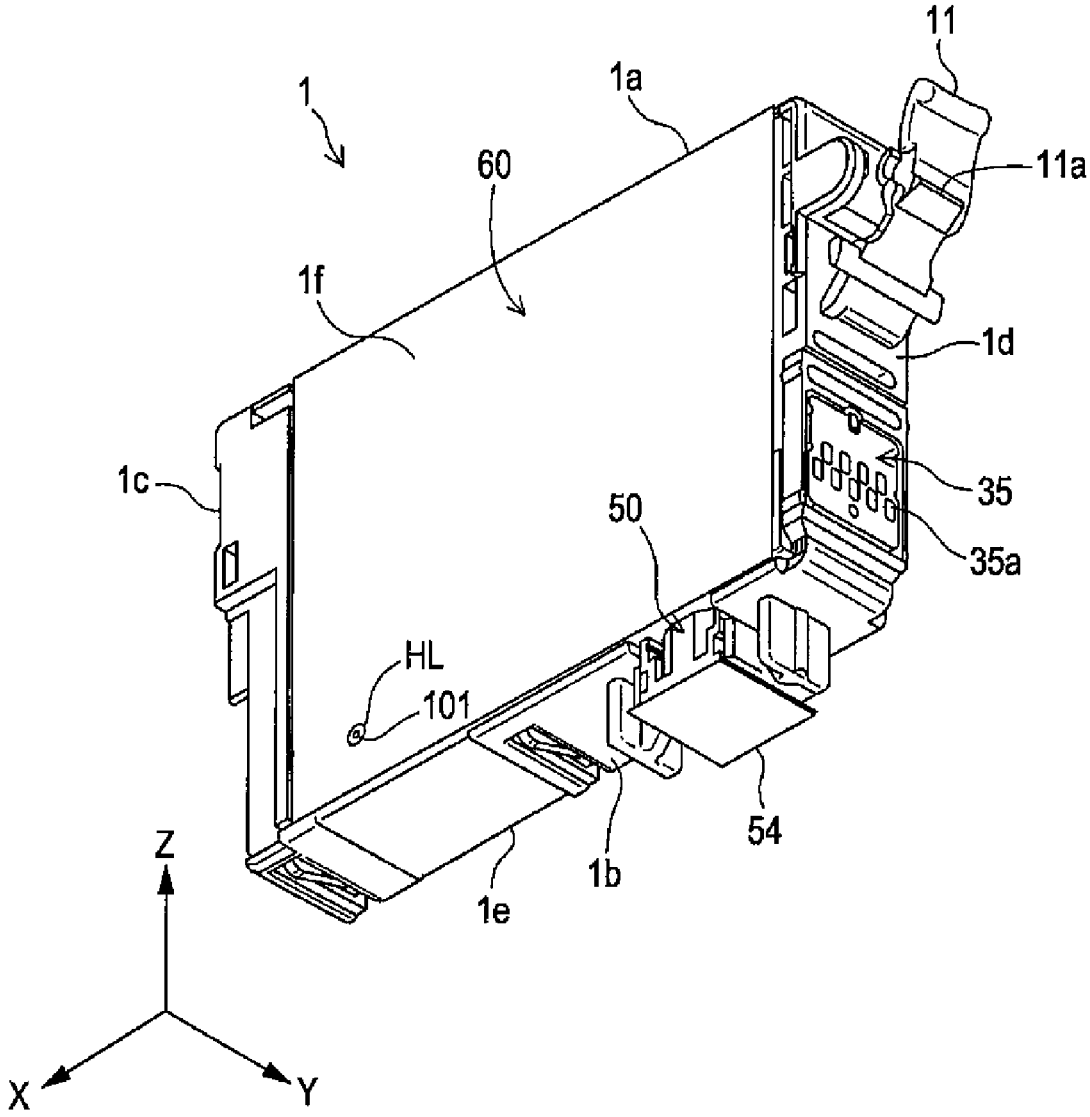
FIG. 2 is a second perspective view showing the appearance of the ink cartridge 1 according to the embodiment.
Figure 3:
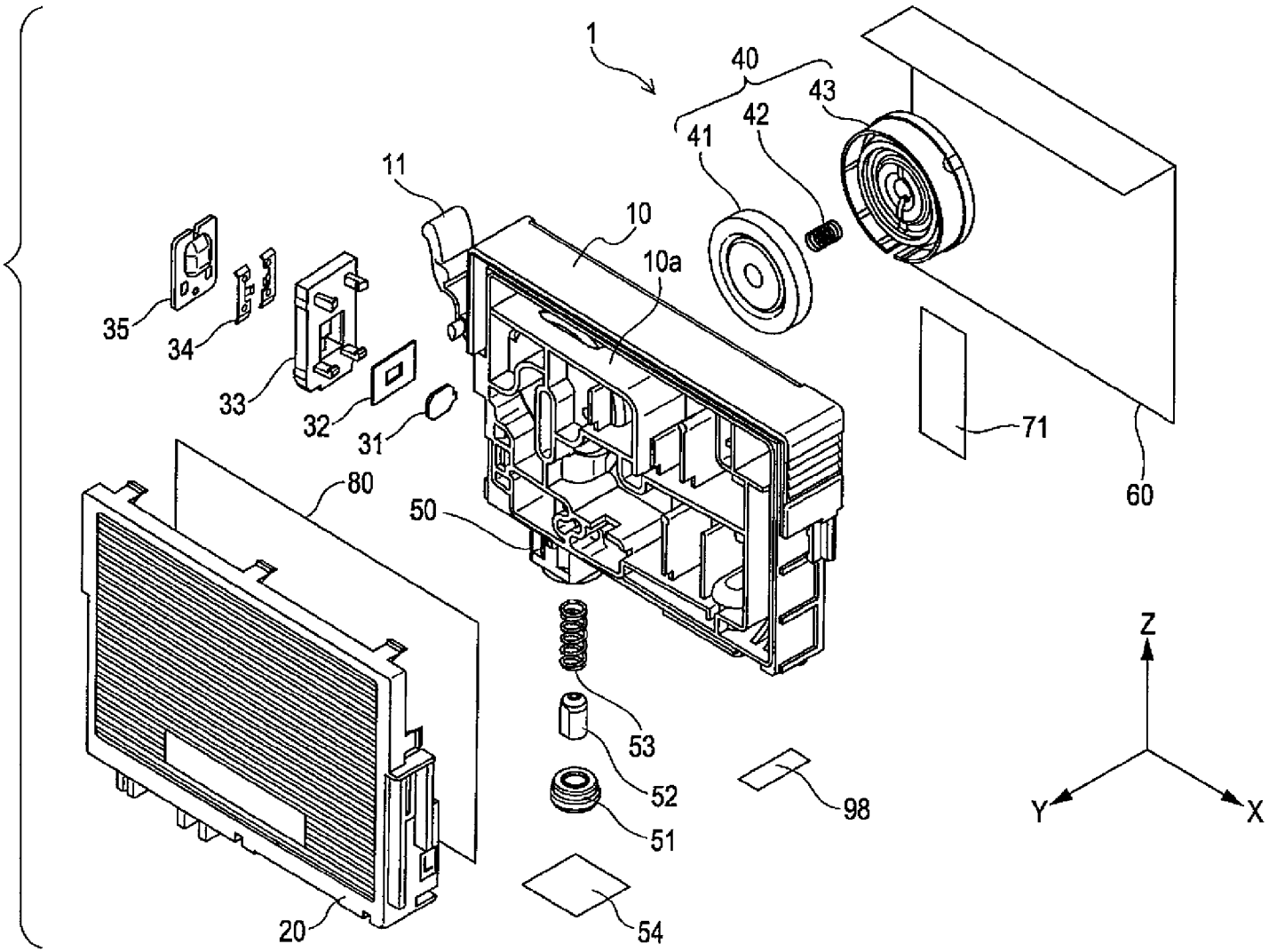
FIG. 3 is an exploded perspective view of the ink cartridge 1 corresponding to FIG. 1.
Figure 4:
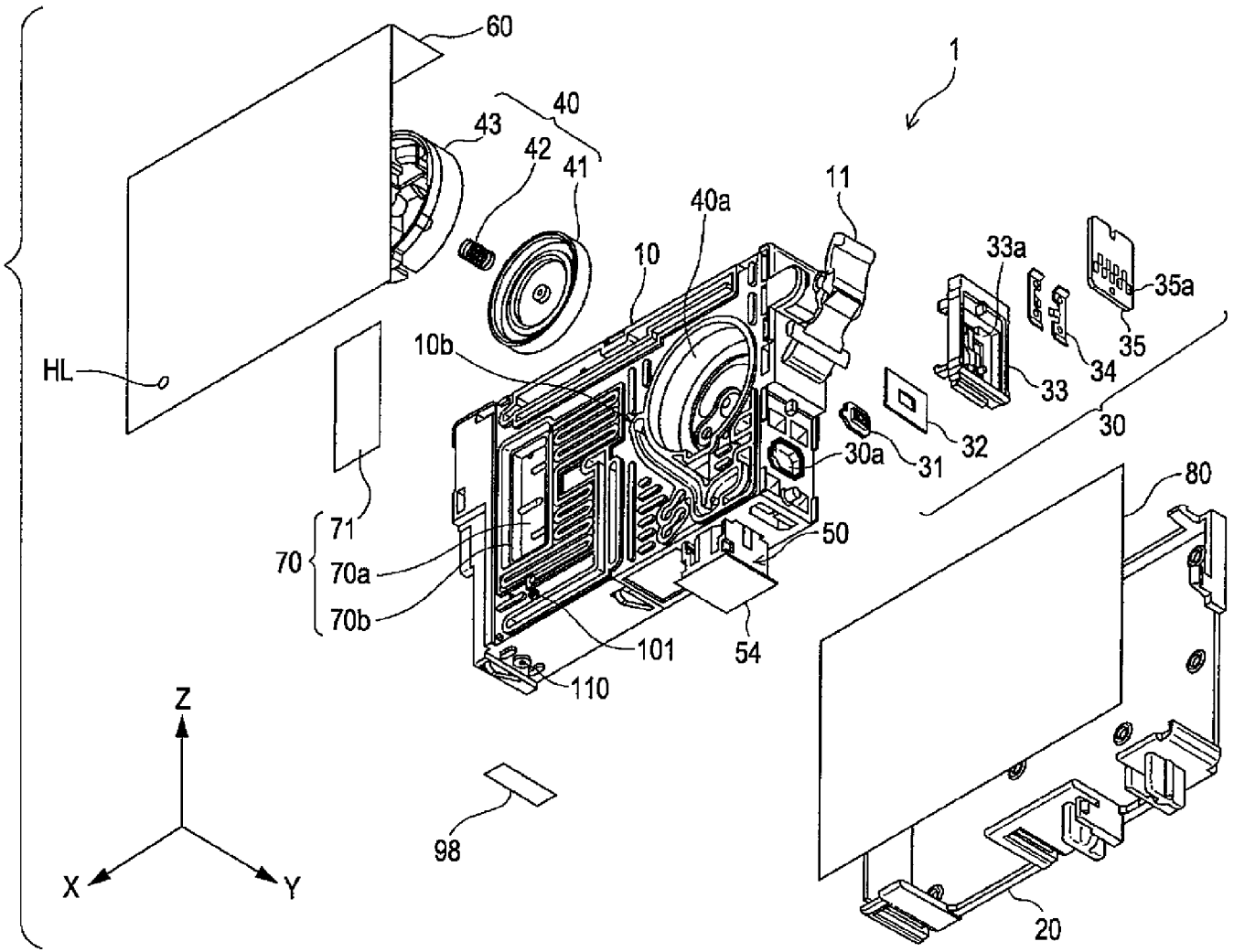
FIG. 4 is an exploded perspective view of the ink cartridge 1 corresponding to FIG. 2.
Figure 5:
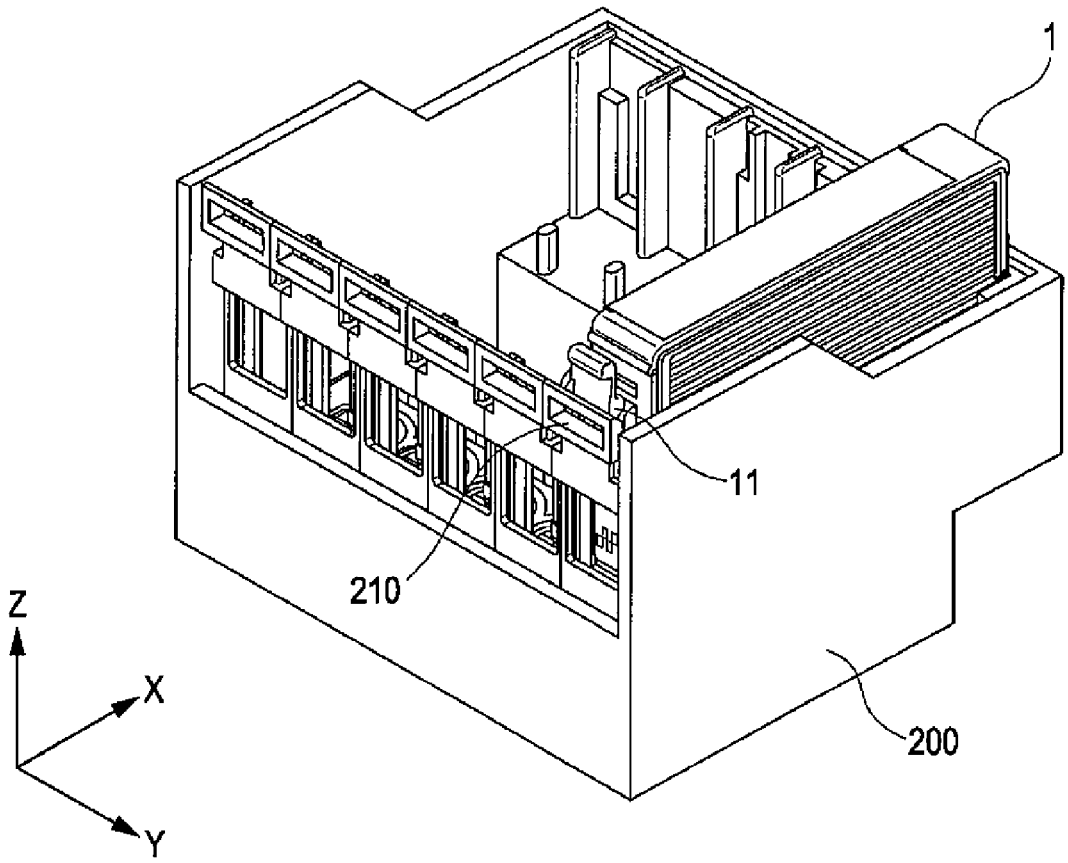
FIG. 5 is a view showing that the ink cartridge is mounted on a carriage.

FIG. 2 is a second perspective view showing the appearance of the ink cartridge 1 according to the embodiment. FIG. 2 is a view seen from a direction opposite to FIG. 1. FIG. 3 is an exploded perspective view of the ink cartridge 1 corresponding to FIG. 1. FIG. 4 is an exploded perspective view of the ink cartridge 1 corresponding to FIG. 2, FIG. 4 is a view seen from a direction opposite to FIG. 3. FIG. 5 is a view showing that the ink cartridge 1 is mounted on a carriage. Meanwhile, in FIGS. 1 to 5, X, Y, and Z axes are shown in order to specify directions.

The ink cartridge 1 contains liquid ink therein. As shown in FIG. 5, the ink cartridge 1 is mounted on a carriage 200 of an ink jet printer, and supplies ink to the ink jet printer.

As shown in FIGS. 1 and 2, the ink cartridge 1 has a substantially rectangular parallelepiped shape. The ink cartridge includes an outer surface 1*a* corresponding to a Z-axis positive direction, an outer surface 1*b* corresponding to a Z-axis negative direction, an outer surface 1*c* corresponding to an X-axis positive direction, an outer surface 1*d* corresponding to an X-axis negative direction, an outer surface 1*e* corresponding to a Y-axis positive direction, and an outer surface 1*f* corresponding to a Y-axis negative direction. In the following description, for convenience of description, the outer surface 1*a* is referred to as an upper surface, the outer surface 1*b* is referred to as a bottom surface, the outer surface 1*c* is referred to as a right side surface, the outer surface 1*d* is referred to as a left side surface, the outer surface 1*e* is referred to as a front surface, and the outer surface 1*f* is referred to as a back surface. Further, sides corresponding to the outer surfaces 1*a* to 1*f* are referred to as an upper side, a bottom side, a right side, a left side, a front side, and a back side, respectively. Among six outer surfaces of the ink cartridge 1, the front surface 1*e* and the back surface 1*f* have the largest area.

A liquid supply section 50, which includes a supply port used to supply ink to the ink jet printer, is provided on the bottom surface 1*b*.

As shown in FIGS. 1 and 2, an engagement lever 11 is provided on the left side surface 1*d*. A protrusion 11*a* is formed at the engagement lever 11. When the ink cartridge is mounted on the carriage 200, the protrusion 11*a* is engaged with a recess 210 formed at the carriage 200. Accordingly, the ink cartridge 1 is fixed to the carriage 200 (FIG. 5). As known from the above description, the carriage 200 is a mounting section on which the ink cartridge 1 is mounted. When the ink jet printer performs printing, the carriage 200 and a print head (not shown) reciprocate in a width direction (main scanning direction) of a print medium as a single body. The main scanning direction is a Y-axis direction in FIG. 5.

A circuit board 35 is provided below the engagement lever 11 on the left side surface 1*d* (FIG. 2). A plurality of electrode terminals 35*a* is formed on the circuit board 35, and the electrode terminals 35*a* are electrically connected to the ink jet printer through electrode terminals (not shown) that are formed at the carriage 200.

An outer surface film 60 is attached to the upper surface (outer surface 1*a*) and the back surface (outer surface 1*f*) of the ink cartridge 1.

In addition, the internal structure and component structure of the ink cartridge 1 will be described with reference to FIGS. 3 and 4. The ink cartridge 1 includes a case 10, and the front side (surface 1*e*) of the case 10 is covered with a lid member 20.

Ribs 10*a* having various shapes are formed at the front side of the case 10 (FIG. 3). A film 80 is provided between the case 10 and the lid member 20. The film 80 covers the front side of the case 10. Further, the film 80 is closely attached to the front end faces of the ribs 10*a* of the case 10 without a gap. A plurality of small rooms, for example, an end chamber and a buffer chamber to be described below are partitioned and formed in the ink cartridge 1 by the ribs 10*a* and the film 80.

A differential pressure regulating valve receiving chamber 40*a* and a gas-liquid separation chamber 70*a* are formed on the back side of the case 10 (FIG. 4). The differential pressure regulating valve receiving chamber 40*a* receives a differential pressure regulating valve 40 that includes a valve member 41, a spring 42, and a spring seat 43. A rim 70*b* is formed on the inner wall that surrounds the bottom surface of the gas-liquid separation chamber 70*a*. Further, a gas-liquid separation film 71 is attached to the rim 70*b*. All of the gas-liquid separation chamber 70*a*, the rim 70*b*, and the gas-liquid separation film 71 form a gas-liquid separation filter 70.

A plurality of grooves 10*b* is formed on the back side of the case 10 (FIG. 4). When the outer surface film 60 is attached to substantially cover the entire back side of the case 10, the grooves 10*b* form various flow passages to be described below, for example, flow passages through which ink or atmosphere flows between the case 10 and the outer surface film 60. Meanwhile, a hole HL is formed at a portion of the outer surface film 60 that corresponds to an atmosphere opening port 101 formed at the case 10. That is, the atmosphere opening port 101 is not covered with the outer surface film 60. As described in detail below, when the ink cartridge 1 is used, an ink storage chamber communicates with the atmosphere through the atmosphere opening port 101.

The structure near the above-mentioned circuit board 35 will be described below. A sensor receiving chamber 30*a* is formed at a portion of the right side surface (outer surface 1*c*) of the case 10 that is close to the bottom surface side (outer surface 1*b*) (FIG. 4). A sensor 31 is received in the sensor receiving chamber 30*a*. The sensor 31 is attached to a cover member 33 by a film 32. An opening of the sensor receiving chamber 30*a*, which faces the right side surface, is covered with the cover member 33, and the above-mentioned circuit board 35 is fixed to the outer surface 33*a* of the cover member 33 with relay terminals 34 therebetween. All of the sensor receiving chamber 30*a*, the sensor 31, the film 32, the cover member 33, the relay terminals 34, and the circuit board 35 are also referred to as a sensing section 30.

Although not shown in detail in the drawings, the sensor 31 includes a cavity that forms a part of an ink flowing section to be described below, a diaphragm that forms a part of a wall surface of the cavity, and a piezoelectric element that is disposed on the diaphragm. Terminals of the piezoelectric element are electrically connected to a part of the electrode terminals of the circuit board 35. When the ink cartridge 1 is mounted on the ink jet printer, the terminals of the piezoelectric element are electrically connected to the ink jet printer through the electrode terminals of the circuit board 35. The ink jet printer can vibrate the diaphragm through the piezoelectric element by applying electrical energy to the piezoelectric element. After that, the ink jet printer can detect whether ink exists in the cavity by detecting the residual vibration characteristics (frequency and the like) of the diaphragm by using the piezoelectric element. Specifically, if the ink stored in the case 10 is exhausted so that the state in the cavity is changed from an ink-filled state to an atmosphere-filled state, the residual vibration characteristics of the diaphragm is changed. The ink jet printer may detect whether ink exists in the cavity by detecting the change in the residual vibration characteristics by using the sensor 31.

Further, a rewritable nonvolatile memory such as an EEPROM (Electronically Erasable and Programmable Read Only Memory) is provided on the circuit board 35, and the ink consumption of the ink jet printer or the like is recorded in the rewritable nonvolatile memory.

The above-mentioned liquid supply section 50 and a decompression hole 110 are provided at the bottom surface of the case 10 (FIG. 4). When ink is injected in the process for manufacturing the ink cartridge 1, air is sucked through the decompression hole 110 so that the inside of the ink cartridge 1 is decompressed.

The respective openings of the liquid supply section 50 and the decompression hole 110 are sealed by sealing films 54 and 9B immediately after the ink cartridge 1 is manufactured. When the ink cartridge 1 is mounted on the carriage 200 of the ink jet printer, the sealing film 54 is broken by an ink supply needle 240 that is provided in the carriage 200.

A spring 53, a spring seat 52, and a sealing member 51 are received in the liquid supply section 50 in this order from the inside thereof (FIG. 3). When the ink supply needle 240 is inserted into the liquid supply section 50, the sealing member 51 seals the liquid supply section so that a gap is not formed between the inner wall of the liquid supply section 50 and the outer wall of the ink supply needle 240. When the ink cartridge 1 is not mounted on the carriage 200, the spring seat 52 comes in contact with the inner wall of the sealing member 51 so as to close the liquid supply section 50. The spring 53 pushes the spring seat 52 so that the spring seat comes in contact with the inner wall of the sealing member 51. When the ink supply needle 240 of the carriage 200 is inserted into the liquid supply section 50, the upper end of the ink supply needle 240 pushes up the spring seat 52, so that a gap is formed between the spring seat 52 and the sealing member 51 and ink is supplied to the ink supply needle 240 through the gap.

Figure 6:
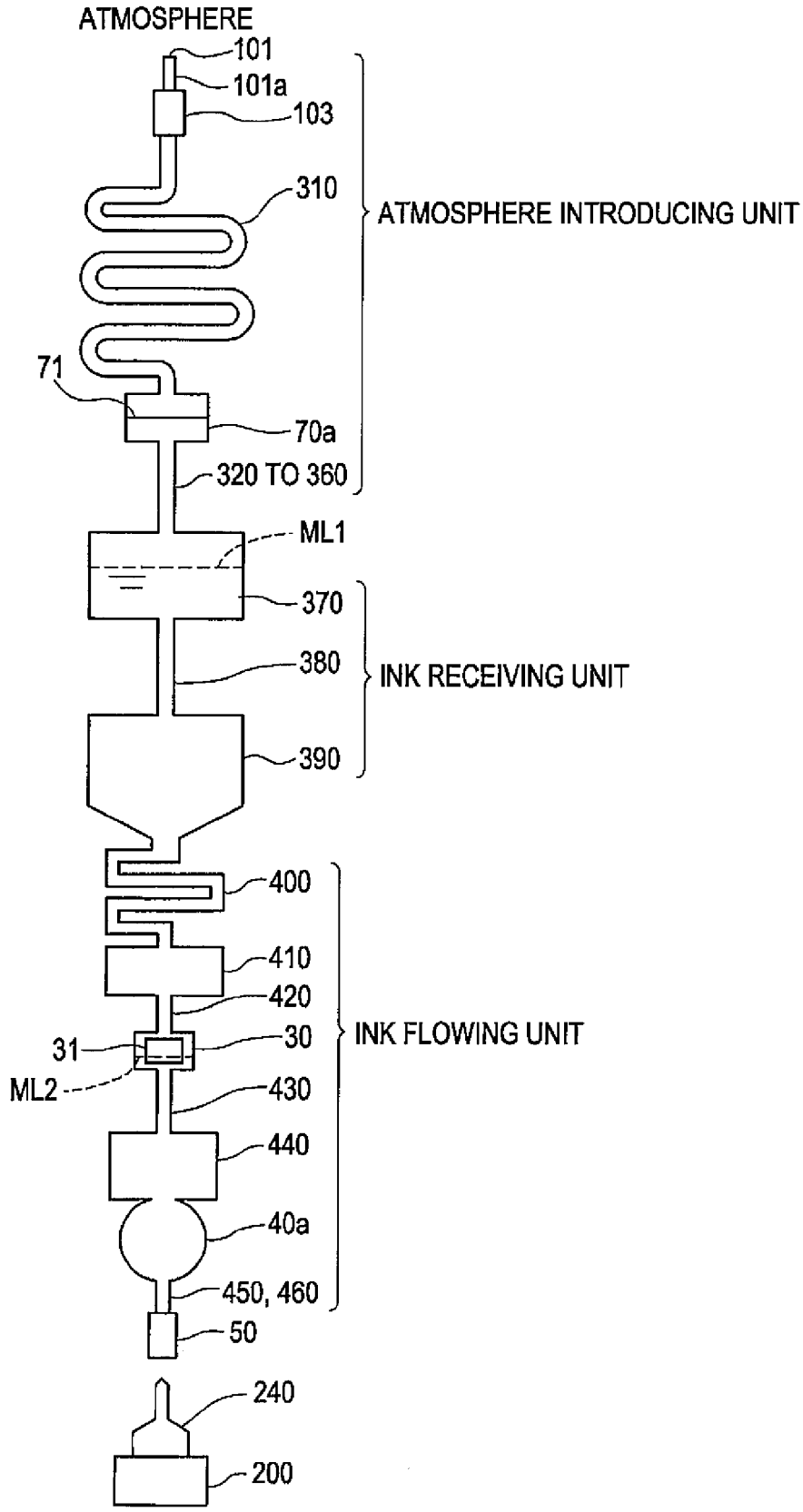
FIG. 6 is a conceptual diagram of a path that reaches a liquid supply section from an atmosphere opening port.

FIG. 6 is a conceptual diagram of a path that reaches the liquid supply section from the atmosphere opening port. For convenience of understanding, a path, which reaches the liquid supply section 50 from the atmosphere opening port 101, will be conceptually described with reference to FIG. 6 before the description of the internal structure of the ink cartridge 1.

The path, which reaches the liquid supply section 50 from the atmosphere opening port 101, may be mainly divided into an ink storage chamber that stores ink, an atmosphere introducing section that is provided on the upstream side of the ink storage chamber, and an ink flowing section that is provided on the downstream side of the ink storage chamber.

The atmosphere introducing section includes the atmosphere opening port 101, an atmosphere communicating hole 101*a*, a connection passage 103, a meandering passage 310, the gas-liquid separation chamber 70*a* in which the gas-liquid separation film 71 is received, and air chambers 320 to 360 that connect the gas-liquid separation chamber 70*a* with the ink storage chamber, in this order from the upstream side. The upstream portion of the connection passage 103 communicates with the atmosphere communicating hole 101*a*, and the downstream portion thereof communicates with the upstream portion of the meandering passage 310. The upstream end of the meandering passage 310 communicates with the connection passage 103, and the downstream end thereof communicates with the gas-liquid separation chamber 70*a*. The meandering passage 310 is elongated and meanders so that the length of the meandering passage is increased between the atmosphere opening port 101 and the ink storage chamber. Accordingly, it may be possible to suppress the evaporation of water in the ink that is stored in the ink storage chamber. The gas-liquid separation film 71 is made of a material that allows the transmission of gas and does not allow the transmission of liquid. The gas-liquid separation film 71 is disposed between the upstream and downstream portions of the gas-liquid separation chamber 70*a*. Accordingly, the gas-liquid separation film may suppress the flow of the ink that flows back from the ink storage chamber toward the upstream side of the gas-liquid separation chamber 70*a*. The detailed structure of the air chambers 320 to 360 will be described below.

The ink storage chamber includes a tank chamber 370, a communication passage 380, and an end chamber 390, in this order from the upstream side. The upstream portion of the communication passage 380 communicates with the tank chamber 370, and the downstream portion of the communication passage 380 communicates with the end chamber 390.

The ink flowing section includes a bubble trapping flow passage 400, a bubble trapping chamber 410, a first flow passage 420, the above-mentioned sensing section 30, a second flow passage 430, a buffer chamber 440, the differential pressure regulating valve receiving chamber 40*a* that receives the above-mentioned differential pressure regulating valve 40, a third flow passage 450, and a fourth flow passage 460, in this order from the upstream side. The bubble trapping flow passage 400 is formed in the shape that sterically has a plurality of bent portions. Since being formed in the above-mentioned shape, the bubble trapping flow passage may trap bubbles contained in the ink and suppress the penetration of bubbles toward the downstream side from the bubble trapping flow passage 400. The bubble trapping chamber 410 discharges the ink, which flows into the upper side of the bubble trapping chamber 410 from the bubble trapping flow passage 400, to the sensing section 30 from the bottom side of the bubble trapping chamber 410 through the second flow passage 430. If bubbles penetrate into the bubble trapping chamber from the bubble trapping flow passage 400, the bubble trapping chamber traps the bubbles at the upper side thereof. The reason for making the bubbles hardly penetrate the downstream side as described above is that the abnormal operation of the sensor 31 occurs when bubbles penetrate into the sensing section 30. The bubble trapping chamber 410 communicates with the first flow passage 420 through a communication hole 412 that is formed at the bubble trapping chamber 410, and the downstream portion of the first flow passage 420 communicates with the sensing section 30.

The upstream end of the second flow passage 430 communicates with the sensing section 30, and the downstream end thereof communicates with the buffer chamber 440. The buffer chamber 440 directly communicates with the differential pressure regulating valve receiving chamber 40*a*. The pressure of the ink, which flows downstream of the differential pressure regulating valve receiving chamber 40*a*, is adjusted to be lower than the pressure of the ink, which flows upstream thereof, by the differential pressure regulating valve 40 in the differential pressure regulating valve receiving chamber 40*a*. Accordingly, the pressure of the ink flowing downstream of the differential pressure regulating valve receiving chamber becomes negative pressure. As a result, the backflow of ink is prevented. The upstream end of the third flow passage 450 communicates with the differential pressure regulating valve receiving chamber 40*a*, and the downstream end thereof communicates with the liquid supply section 50 through the fourth flow passage 460.

When the ink cartridge 1 is manufactured, ink is filled up to the liquid level in the tank chamber 370 which is conceptually shown by a broken line ML1 in FIG. 6. As the ink contained in the ink cartridge 1 is consumed by the ink jet printer, the liquid level is moved toward the downstream side and atmosphere is introduced instead from the upstream side into the ink cartridge 1 through the atmosphere opening port 101. Further, as ink is consumed, the liquid level reaches the sensing section 30 conceptually shown by a broken line ML2 in FIG. 6. In this case, atmosphere is introduced into the sensing section 30, and the sensor 31 of the printer detects that ink is not present in the sensing section 30. After this detection, the printer stops printing before the ink existing on the downstream side (in the buffer chamber 440 or the like) of the sensing section 30 is completely consumed. Then, the printer notifies a user of ink exhaustion. In this way, it may be possible to prevent printing from being performed when air is held in the print head.

Figure 7:
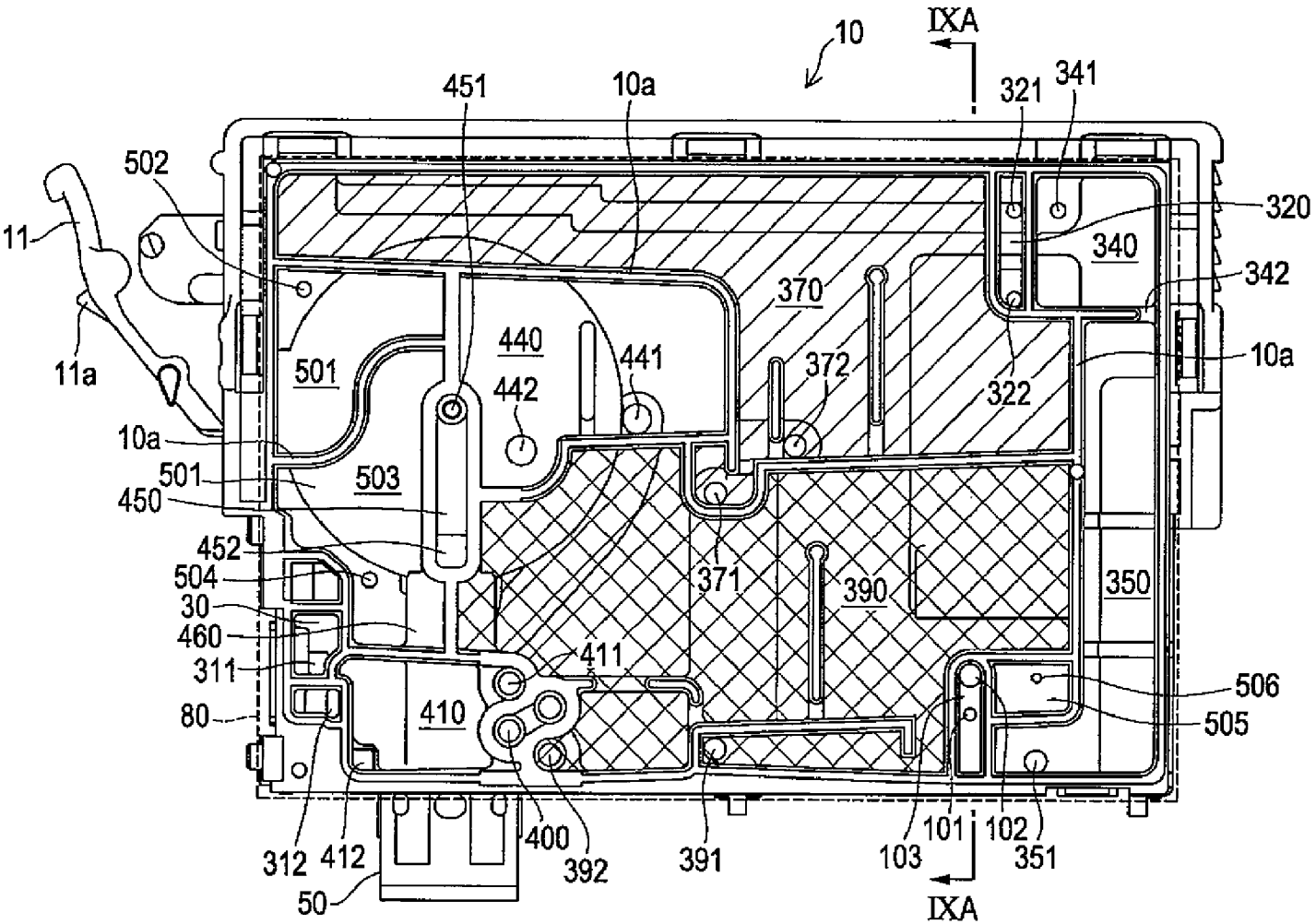
FIG. 7 is a view of a case 10 as seen from the front side.
Figure 8:
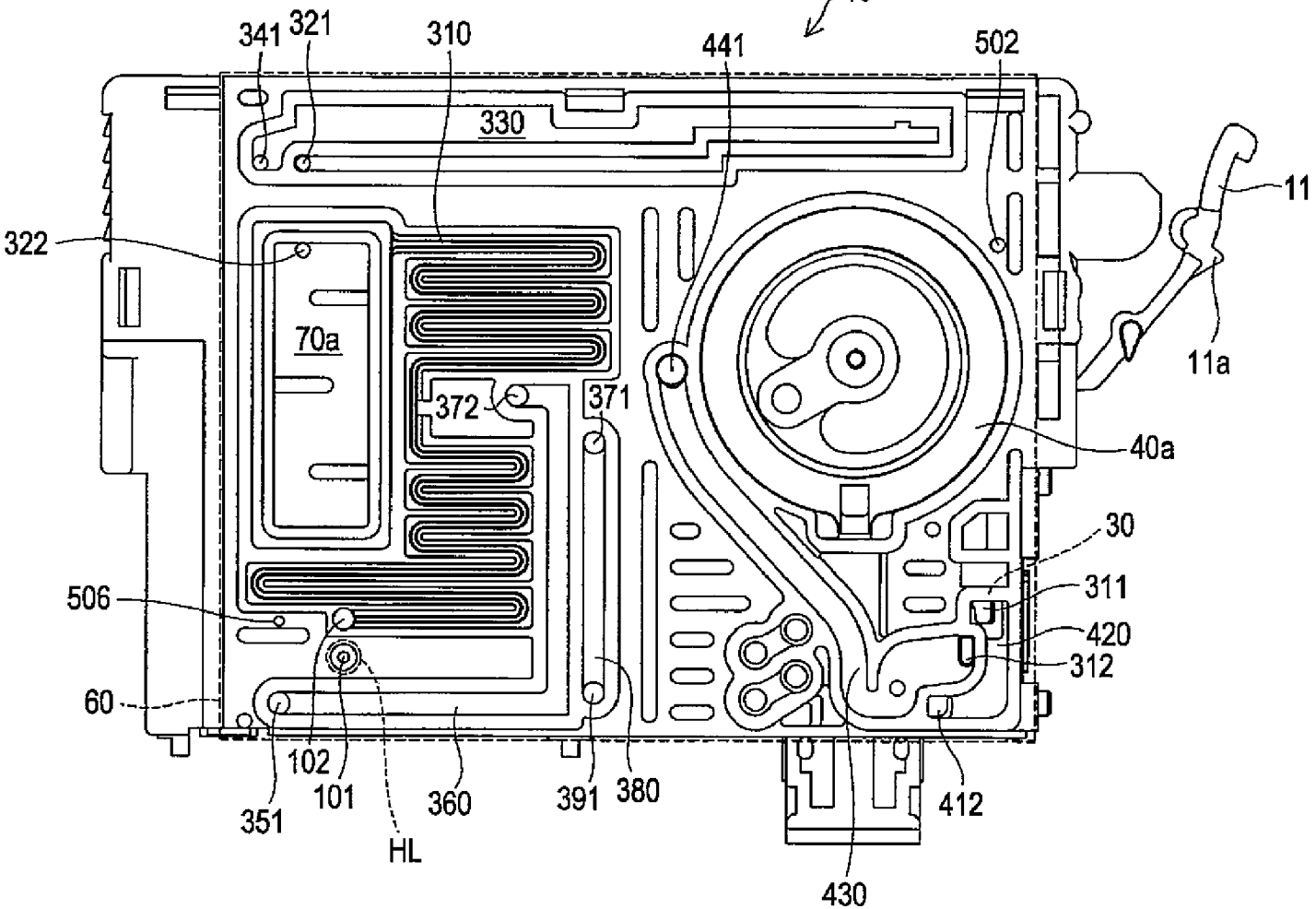
FIG. 8 is a view of the case 10 as seen from the back side.

The detailed structure of each of the components, which are provided in the ink cartridge 1 on the path between the atmosphere opening port 101 and the liquid supply section 50, will be described with reference to FIGS. 7 and 8 on the basis of the above description. FIG. 7 is a view of the case 10 as seen from the front side. FIG. 8 is a view of the case 10 as seen from the back side. In FIG. 7, a portion covered with the film 80 is shown by a broken line. In FIG. 8, a portion covered with the outer surface film 60 is shown by a broken line.

The tank chamber 370 and the end chamber 390 of the ink storage chamber are formed on the front side of the case 10. In FIG. 7, the tank chamber 370 and the end chamber 390 are shown by single hatching and cross hatching, respectively. The communication passage 380 is formed in the middle of the case 10 on the back side of the case as shown in FIG. 8. The communication hole 371 is a hole that makes the upstream end of the communication passage 380 and the tank chamber 370 communicate with each other, and the communication hole 391 is a hole that makes the downstream end of the communication passage 380 and the end chamber 390 communicate with each other.

The atmosphere opening port 101, the meandering passage 310, and the gas-liquid separation chamber 70*a* of the atmosphere introducing section are formed at positions that are close to the right side surface on the back side of the case 10 as shown in FIG. 8. The connection passage 103 of the atmosphere introducing section is formed at a position that is close to the right side surface on the front surface side of the case 10 as shown in FIG. 7. The atmosphere communicating hole 101*a* is a communication passage of which one end is exposed to the back surface if as an atmosphere opening port 101 and the other end is connected to the connection passage 103. The atmosphere communicating hole 101*a* is a through hole that passes through the case 10 from the back surface 1*f* to the front surface 1*e*. Further, the peripheral wall of the atmosphere communicating hole 101*a* is perpendicular to the back surface 1*f* (and the front surface 1*e*). The communication hole 102 is a communication passage of which one end is connected to the upstream end of the meandering passage 310 and the other end is connected to the connection passage 103. The communication hole 102 is a through hole that passes through the case 10 from the back surface 1*f* to the front surface 1*e*. Furthermore, the peripheral wall of the communication hole 102 is perpendicular to the back surface 1*f* (and the front surface 1*e*). The downstream end of the meandering passage 310 passes through the side wall of the gas-liquid separation chamber 70*a* and communicates with the gas-liquid separation chamber 70*a*.

The air chambers 320 to 360 of the atmosphere introducing section shown in FIG. 6 are formed of the air chambers 320, 340, and 350 (FIG. 7) disposed on the front side of the case 10 and the air chambers 330 and 360 (FIG. 8) disposed on the back side of the case 10, and the spaces of the air chambers are connected to one another in series in order of reference numerals from the upstream side so as to form an integral flow passage. The communication hole 322 is a hole that makes the gas-liquid separation chamber 70*a* and the air chamber 320 communicate with each other. A communication hole 321 is a hole that makes the air chambers 320 and 330 communicate with each other, and a communication hole 341 is a hole that makes the air chambers 330 and 340 communicate with each other. The air chambers 340 and 350 communicate with each other by a notch 342 that is formed at a rib isolating the air chamber 340 from the air chamber 350. A communication hole 351 is a hole that makes the air chambers 350 and 360 communicate with each other, and a communication hole 372 is a hole that makes the air chamber 360 and tank chamber 370 communicate with each other. It may be possible to suppress the backflow of ink to the gas-liquid separation chamber 70*a* from the tank chamber 370 by providing the air chambers that are partitioned into a plurality of air chambers and sterically formed as described above.

The bubble trapping flow passage 400 and the bubble trapping chamber 410 of the ink flowing section are formed at positions that are close to the liquid supply section 50 on the front side of the case 10 as shown in FIG. 7. A communication hole 392 communicating with the bubble trapping flow passage 400 is formed at the end chamber 390. The bubble trapping flow passage 400 is formed so that a cylindrical flow passage communicates with the bubble trapping chamber 410 through the communication hole 411 and is led toward the upper surface while returning between the front and back sides of the case 10. As described with reference to FIG. 4, the sensing section 30 is disposed at a portion of the left side surface of the case 10 that is close to the bottom surface side (FIGS. 7 and 8).

As shown in FIG. 8, a first flow passage 420 that makes the bubble trapping chamber 410 and the sensing section 30 communicate with each other, and the second flow passage 430 that makes the sensing section 30 and the buffer chamber 440 communicate with each other are formed on the back side of the case 10. The communication hole 412 is formed at the bubble trapping chamber 410, so that the bubble trapping chamber 410 and the first flow passage 420 communicate with each other. A communication hole 311 is a hole that makes the first flow passage 420 and the sensing section 30 communicate with each other. Further, a communication hole 312 is a hole that makes the sensing section 30 and the second flow passage 430 communicate with each other.

The buffer chamber 440 and the third flow passage 450 are formed at portions of the front surface of the case 10 that are close to the left side surface as shown in FIG. 7. A communication hole 441 is a hole that makes the downstream end of the second flow passage 430 and the buffer chamber 440 communicate with each other. A communication hole 442 is a hole that makes the buffer chamber 440 and the differential pressure regulating valve receiving chamber 40*a* directly communicate with each other. A communication hole 451 is a hole that makes the differential pressure regulating valve receiving chamber 40*a* and the third flow passage 450 communicate with each other. A communication hole 452 is a hole that makes the third flow passage 450 and a flow passage (not shown) in the liquid supply section 50 communicate with each other.

Further, spaces 501, 503, and 505 shown in FIG. 7 are unfilled chambers that are not filled with ink. The unfilled chambers 501, 503, and 505 are not disposed on the path that reaches the liquid supply section 50 from the atmosphere opening port 101, and are independent of one another. An atmosphere opening port 502, which communicates with the atmosphere; is provided on the back side of the unfilled chamber 501. Likewise, atmosphere opening ports 504 and 506, which communicate with the atmosphere, are provided on the back sides of the unfilled chambers 503 and 505, respectively. When the ink cartridge 1 is packed by a decompression pack, the unfilled chambers 501, 503, and 505 become deaerating chambers where negative pressure is accumulated. Accordingly, while the ink cartridge 1 is packed, the pressure in the case 10 is keep at a defined value or less. Therefore, it may be possible to supply ink that contains a small amount of dissolved air.

Figure 9B:
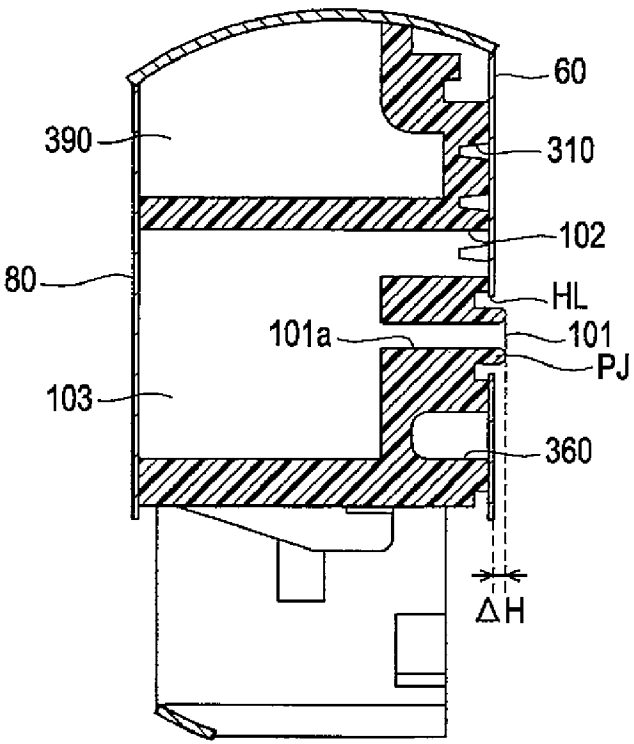
FIGS. 9A and 9B are the views showing the structure of a first embodiment near an atmosphere opening port.
Figure 9A:
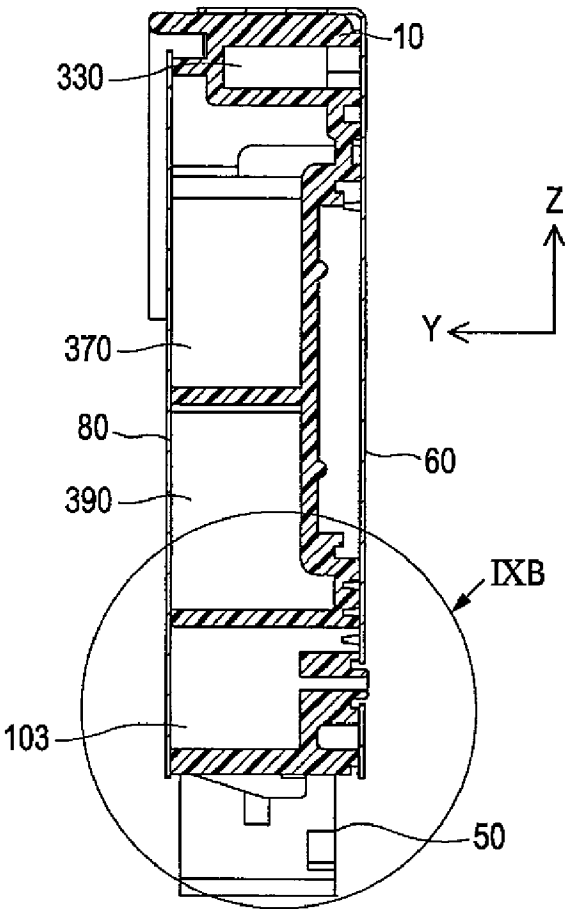

Structure Near Atmosphere Opening Port:

FIG. 9 is a view showing the structure of the first embodiment near the atmosphere opening port 101. FIG. 9 shows a cross-sectional view taken along a line IX(A)-IX(A) of FIG. 7 and an enlarged view of a portion near the atmosphere opening port 101 in the cross-sectional view. The meandering passage 310 has the shape of a groove that is formed to be opened on the back side of the case 10 and relatively elongated and shallow, and is partitioned and formed by the outer surface film 60 that seals the opening of the groove-shaped meandering passage. Meanwhile, the connection passage 103 has the shape of a groove that is formed in a Z-axis direction so as to be opened on the front side of the case 10 and is relatively deep, and is partitioned and formed by the film 80 that seals the opening of the groove-shaped connection passage. The upstream end of the meandering passage 310 is connected to the upstream end of the connection passage 103 through the communication hole 102. The connection passage 103 is connected to the atmosphere opening port 101 through the atmosphere communicating hole 101*a*. As a result, an atmosphere introducing path, which reaches the atmosphere opening port 101, the atmosphere communicating hole 101*a*, the connection passage 103, the communication hole 102, and the meandering passage 310 in this order from the upstream side, is formed. The atmosphere introducing path is formed of the grooves that are formed on the front or back side of the case 10, or the through holes that are perpendicular to the front or back surface of the case. That is, the atmosphere introducing path may be formed by drilling or punching in a direction perpendicular to the front and back surfaces of the case 10 (in a Y-axis direction) and attaching the films 60 and 80, and has been researched so as to be easily formed.

The atmosphere opening port 101 is not covered with the outer surface film 60 and is exposed to the back surface 1*f*. Further, a protruding portion PJ is formed at the outer edge portion of the atmosphere opening port 101. That is, the outer edge portion (protruding portion PJ) of the atmosphere opening port 101 protrudes outward from the back surface 1*f* (the surface of the outer surface film 60) of the ink cartridge 1 by a predetermined length ΔH. The protruding portion PJ has the shape of a circle without voids as seen from the back side. As described above, the meandering passage 310 formed on the back surface 1*f* is not directly connected to the atmosphere opening port 101 that is opened on the same back side. The meandering passage 310 formed on the back surface 1*f* is connected to the connection passage 103, which is formed on the front surface 1*e*, by the communication passage 102 that passes through the case 10 from the back surface 1*f* toward the front surface 1*e*. Further, the meandering passage is connected to the atmosphere opening port 101 by the communication passage 101*a* that passes through the case 10 from the back surface 1*f* toward the front surface 1*e*. Accordingly, it may be possible to form the protruding portion PJ in the shape of a circle without voids. Since the protruding portion PJ is formed in the shape of a circle without voids, the entire outer edge portion of the atmosphere opening port 101 is sealed by the inner surface of a packing member. Accordingly, the atmosphere opening port 101 is more reliably sealed. Sealing the atmosphere opening port 101 by the inner surface of the packing member will be described below.

Figure 10:
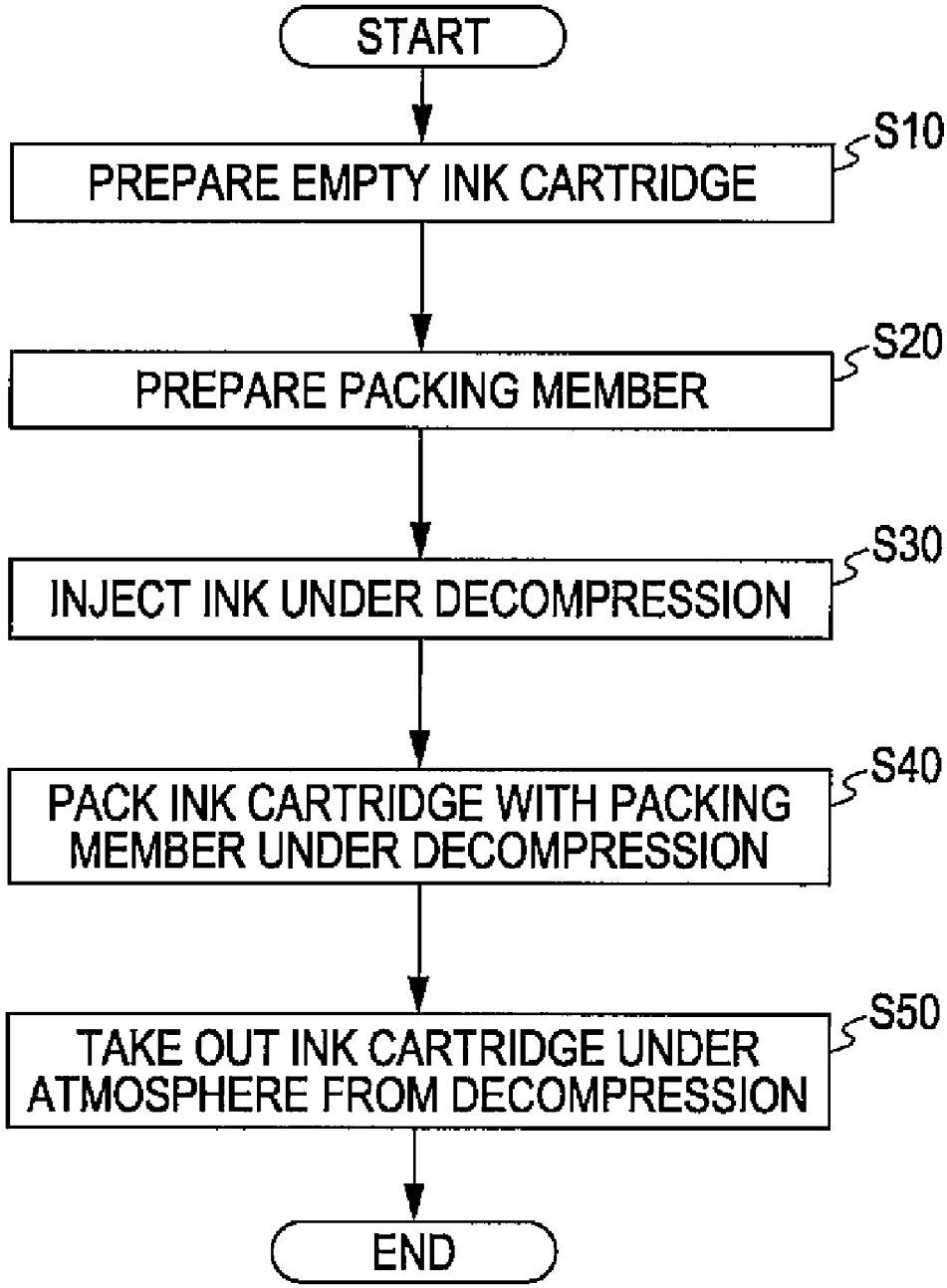
FIG. 10 is a flowchart illustrating steps of a process for manufacturing an ink cartridge.
Figure 11A:
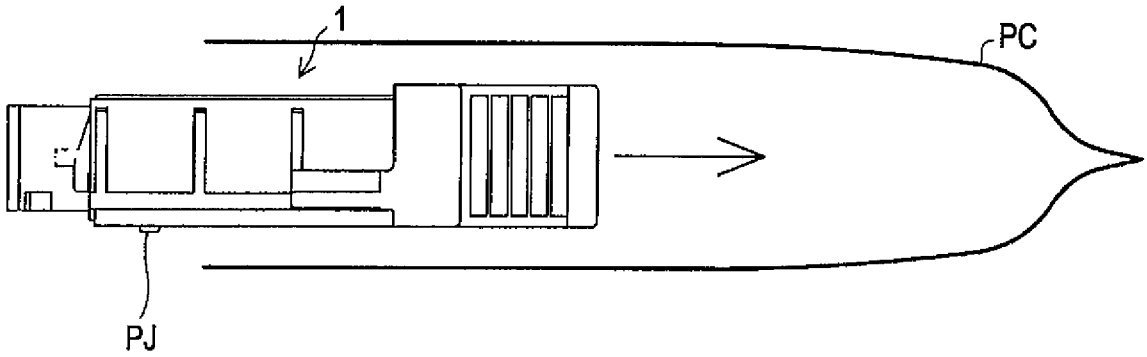
FIGS. 11A-11C are the views illustrating the process for manufacturing the ink cartridge.

Method of Manufacturing Ink Cartridge:

FIG. 10 is a flowchart illustrating steps of a process for manufacturing an ink cartridge. FIG. 11 is a view illustrating the process for manufacturing the ink cartridge. First, an empty ink cartridge 1 is prepared (Step S10). Further, a packing member PC is prepared (Step S20). The packing member PC is formed of an airtight sheet that does not allow the transmission of air, and is formed airtight except for an opening through which the ink cartridge 1 is brought (FIG. 11A).

Further, ink is injected into ink cartridge 1 (Step S30). The details of the injection of the ink are omitted. However, for example, while air is sucked through the decompression hole 110 so that the inside of the ink cartridge 1 is decompressed, the ink may be injected from the liquid supply section 50. In this case, the third flow passage 450 is not completely sealed by the film 80. Accordingly, ink bypasses the differential pressure regulating valve 40 through the gap between the third flow passage 450 and the film 80, and is injected into the ink cartridge 1. After the injection of ink, the third flow passage 450 and the film 80 are thermally fused and attached to each other, thereby being completely sealed.

Figure 11B:
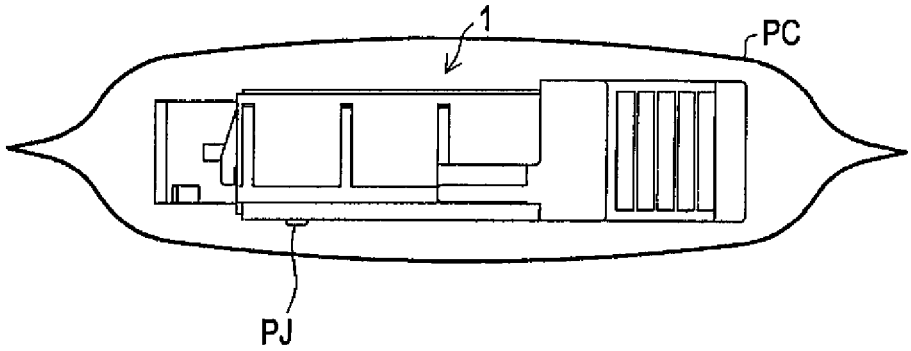

The ink cartridge 1 into which ink is injected is packed by the packing member PC under decompression (Step S40). For example, in a vacuumized chamber, the ink cartridge 1 is brought in the packing member PC (FIG. 11A) and the opening of the packing member PC is hermetically sealed (FIG. 11B).

Figure 11C:
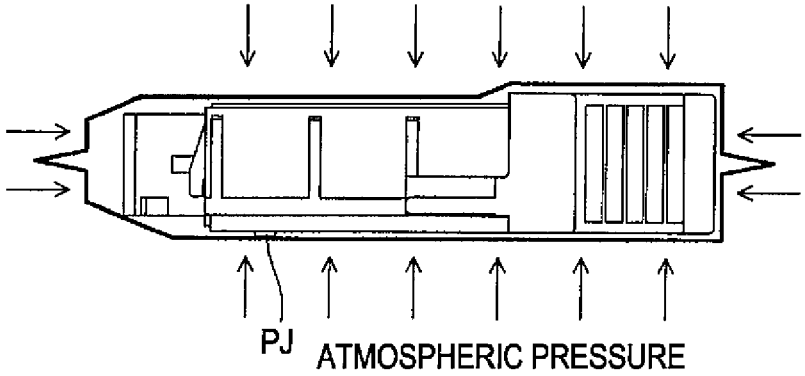

After the ink cartridge 1 is packed, the ink cartridge 1 is taken out under the atmosphere from the decompression atmosphere (Step S50). For example, the ink cartridge 1 is transferred from the inside of the decompressed chamber to the atmosphere. Accordingly, the packing member PC is pressed against the ink cartridge so as to be in close contact with the ink cartridge 1 due to the difference in pressure between the air in the packing member PC and the atmosphere outside the packing member PC (FIG. 11C). As a result, the inner surface of the packing member PC is pressed against the protruding portion PJ of the atmosphere opening port 101 due to the atmospheric pressure, so that the gap between the atmosphere opening port 101 and the inner surface of the packing member PC is sealed and the atmosphere opening port 101 is closed. A valve for opening and closing the atmosphere opening port is not provided at the atmosphere opening port 101. Further, a sealing member (a releasable film, plug, or the like) for blocking the atmosphere opening port 101 is also not provided at the atmosphere opening port. However, the atmosphere opening port 101 is sealed instead by a pressing force that is applied to the packing member PC from the outside due to the atmospheric pressure. Accordingly, it may be possible to sufficiently suppress the discharge of moisture from the inside of the ink cartridge 1. Even if the moisture in the ink cartridge 1 is leaked to the inside of the packing member PC through the atmosphere opening port 101 and is transmitted through the packing member PC and then discharged to the outside, the moisture is discharged merely at a portion (atmosphere opening port 101). Naturally, the amount of moisture, which is discharged in this case, is very small. As a result, it may be possible to suppress disadvantages such as the increase in the viscosity of ink.

Further, the atmosphere opening port 101 is opened on the back surface that is one of two surfaces (front and back surfaces) having the largest area among the outer surfaces of the ink cartridge 1. The pressing force that is applied to the packing member PC from the outside due to the atmospheric pressure, that is, a force that presses the packing member PC against the back surface of the ink cartridge 1 (a force based on the atmospheric pressure) is increased by as much as the increase in the size of the area. As a result, it may be possible to improve the reliability of the seal of the atmosphere opening port 101.

Furthermore, since the protruding portion PJ protrudes from the back surface 1*f* by a predetermined length ΔH, the pressing force that is applied to the packing member PC from the outside due to the atmospheric pressure is applied substantially to the entire back surface 1*f* and is further concentrated on the protruding portion PJ. Therefore, it may be possible to more reliably seal the atmosphere opening port 101.

The atmosphere opening port 101 is sealed and closed by the inner surface of the packing member PC. A valve for opening and closing the atmosphere opening port is not provided at the atmosphere opening port 101. Further, a sealing member (a releasable film, plug, or the like) for blocking the atmosphere opening port 101 is also not provided at the atmosphere opening port. Accordingly, if a user opens the packing member PC and takes out the ink cartridge 1, the ink storage chamber communicates with the atmosphere through the atmosphere opening port 101, so that the ink cartridge 1 is available. For this reason, since a user does not need to remove the sealing member, convenience is improved. There is no concern that a user might forget to remove the sealing member. Further, since it is not necessary to provide a component, such as a valve or a sealing member, it may be possible to reduce the number of components or the manufacturing cost. In addition, since a valve is not provided, it is not necessary to provide the structure required for opening the valve when the ink cartridge 1 is mounted on the printer. Accordingly, it may be possible to reduce the manufacturing cost or the number of components of the printer as well as the manufacturing cost or the number of components of the ink cartridge 1.

B. Second Embodiment

Figure 12A:
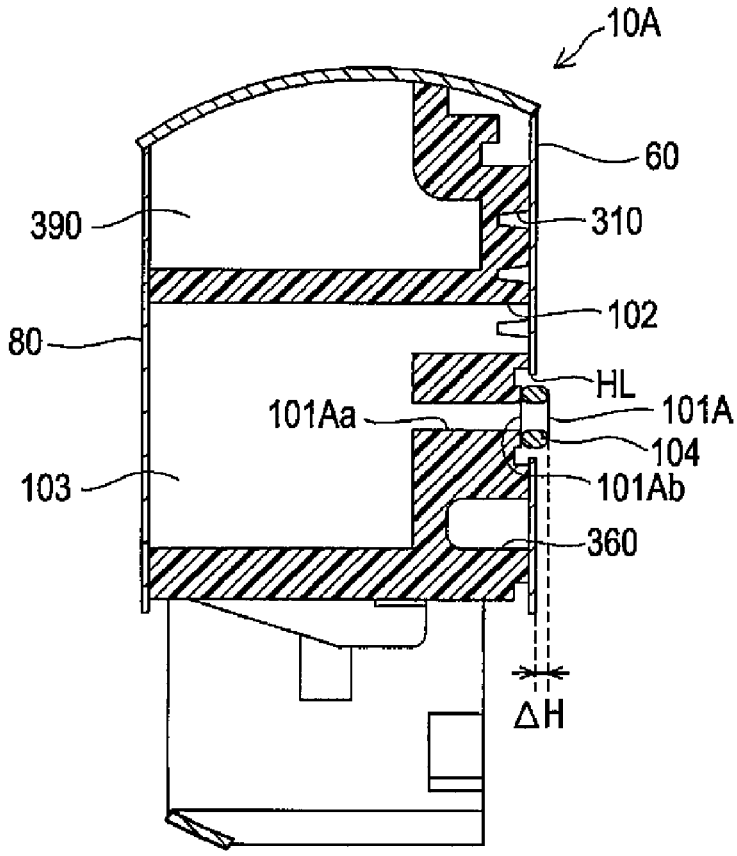
FIGS. 12A and 12B are the views showing the structure of a second embodiment near an atmosphere opening port 101A.
Figure 12B:
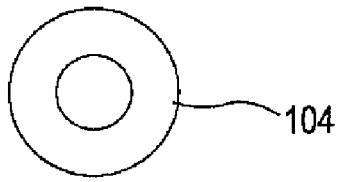

FIG. 12 is a view showing the structure of a second embodiment near an atmosphere opening port 101A. The atmosphere opening port 101A of the second embodiment is different from the atmosphere opening port 101 of the first embodiment, and is formed by separately providing another member on the case 10. As shown in FIG. 12A, a sealing ring 104, which is another member, is provided at a portion of an ink cartridge 1 according to the second embodiment that corresponds to the protruding portion PJ of the first embodiment (at the outer edge portion of the atmosphere opening port 101A). The second embodiment is the same as the first embodiment except for this. FIG. 12B is a view of the sealing ring 104 as seen from the right side of FIG. 12A. For example, the sealing member has an annular shape, and the radial cross section of an annular portion of the sealing member has an oval shape. The sealing ring 104 is made of an elastic material, such as rubber or an elastomer. For example, the sealing ring 104 is attached to the outer edge portion of an opening 101Ab of an atmosphere communicating hole 101Aa by an adhesive. That is, the opening 101Ab of the atmosphere communicating hole 101Aa forms an inlet of the atmosphere introducing section of the case 10, and the sealing ring 104 is provided at the outer edge portion of the opening. An opening formed at one end of the sealing ring 104 functions as the atmosphere opening port 101A, and an opening formed at the other end thereof is connected to the opening 101Ab of the atmosphere communicating hole 101Aa. When the ink cartridge 1 is packed by a packing member PC in the same process as the first embodiment, a gap between the atmosphere opening port 101A and the inner surface of the packing member PC is hermetically sealed and closed by the sealing ring 104.

According to the above-mentioned second embodiment, it may be possible to obtain the same advantage as the first embodiment except that the number of components and the cost are slightly increased due to the addition of the sealing ring 104. Further, in the first embodiment, the protruding portion PJ has the shape of a circle without voids. Accordingly, the entire outer edge portion of the atmosphere opening port 101 is sealed by the inner surface of the packing member, so that it has been possible to obtain the advantage of more reliably sealing the atmosphere opening port 101. Even in the second embodiment, the inlet (opening 101Ab) of the atmosphere introducing section has the shape of a circle without voids. Accordingly, the entire outer edge portion of the inlet is sealed by the sealing ring 104, so that it may be possible to obtain the same advantage as the first embodiment. Further, since the sealing ring 104 has elasticity, the sealing ring 104 and the packing member PC are in close contact with each other. Accordingly, the sealing performance of the outer edge portion of the atmosphere opening port 101A is improved and the reliability of the seal of the atmosphere opening port 101 is improved, so that it may be possible to further suppress the discharge of moisture from the inside of the ink cartridge 1.

C. Third Embodiment

Figure 13A:
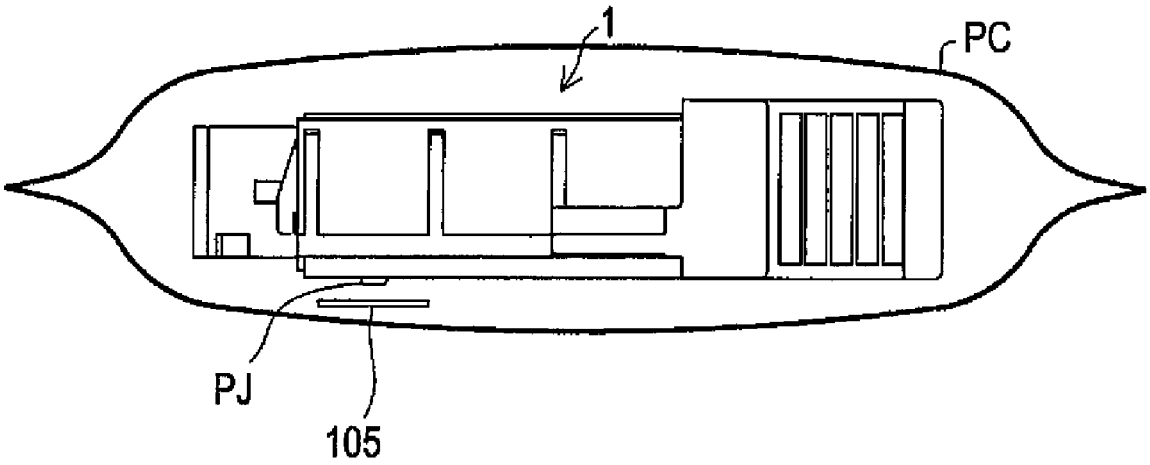
FIGS. 13A and 13B are the views illustrating a process for manufacturing an ink cartridge according to a third embodiment.
Figure 13B:
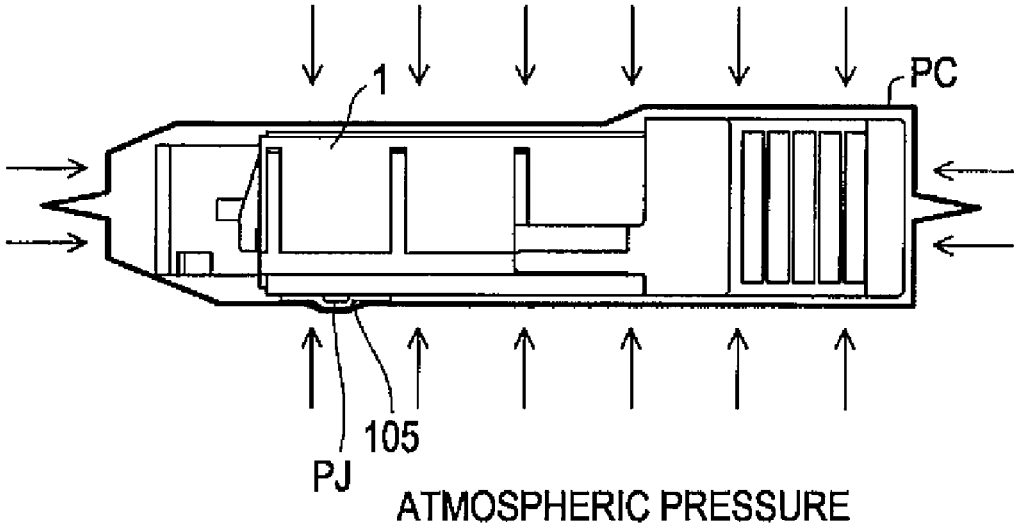

FIG. 13 is a view illustrating a process for manufacturing an ink cartridge according to a third embodiment. The ink cartridge 1 (10) and the packing member PC to be used are the same as the first or second embodiment. The third embodiment is different from the first and second embodiments in that a sealing sheet 105 is interposed between the inner surface of the packing member PC and the opening of the atmosphere opening port 101 (101A) of the ink cartridge 1 (10) (FIG. 13A). If Step S40 of FIG. 10 is performed in this state as shown in FIG. 13B, the sealing sheet 105 is pressed against the atmosphere opening port 101 (101A) by the pressing force that is applied to the packing member PC from the outside due to the atmospheric pressure. As a result, the gap between the opening of the atmosphere opening port 101 (101A) and the inner surface of the packing member PC is hermetically sealed while the sealing sheet 105 is interposed between the opening of the atmosphere opening port and the inner surface of the packing member. Meanwhile, the sealing sheet 105 is not fixed to the ink cartridge 1 (10) by adhesion, insertion, or the like, but merely interposed between the ink cartridge 1 (10) and the packing member PC.

According to the above-mentioned third embodiment, it may be possible to obtain the same advantage as the first or second embodiment except that the number of components and the cost are slightly increased due to the addition of the sealing sheet 105. Further, it may be possible to further suppress the discharge of moisture from the inside of the ink cartridge 1 (10) through the addition of the sealing sheet 105 in comparison with the first or second embodiment.

D. Modifications

First Modification:

In the second embodiment, the sealing ring 104 has been attached to the outer edge portion of the atmosphere opening port 101 of the ink cartridge 1 by an adhesive. However, the sealing ring may not be attached to the outer edge portion of the atmosphere opening port. Further, the sealing ring 104 may be thermally fused and attached to the inner surface of the packing member PC. Furthermore, in the process for manufacturing the case 10, the sealing ring 104 may be integrally formed with the case 10. For example, if the case 10 is made of a resin, the sealing ring 104 may be integrally formed with the case 10 by two-color molding. Specifically, the case 10 is molded with a predetermined resin by using a first mold, and the sealing ring is molded with an elastomer or the like on the outer edge portion of the opening 101Ab of the case 10 by using a second mold. In this case, it may be possible to omit a step of attaching the sealing ring 104 to the case 10 by an adhesive. Further, since it may be possible to decrease the difference between the positions of the sealing ring 104 and the opening 101Ab, it may be possible to more reliably seal the atmosphere opening port.

Second Modification:

In the first embodiment, after packing, the inner surface of the packing member PC and the protruding portion PJ may be fixed to each other by thermal fusions and attachment or the like. In this case, it is preferable that the protruding portion PJ and the packing member PC be attached to each other by a certain degree of weak adhesion so as to be easily separated from each other when the packing member PC is opened and the ink cartridge 1 is taken out.

Third Modification:

Various flow passages or receiving chambers and communication holes of the ink cartridge have been described in the above-mentioned embodiments, but a part of them may be arbitrarily omitted or modified. For example, the outer surfaces of the cartridge 1 may be connected to each other by a smooth curved surface or the outer surface may have other shapes except for a quadrangular shape so that the appearance of the ink cartridge 1 is changed. The shape of the case 10 or the lid member may be modified. A part of components provided on the case 10 (for example, the engagement lever 11) may be provided on the lid member 20. On the contrary, a part of components provided on the lid member 20 may be provided on the case 10. The structure of the flow passage may be simplified, or the positional relationship of the receiving chamber or the flow passage may be changed.

Fourth Modification:

The ink supply system of an ink jet printer has been described in each of the embodiments. However, the invention may be generally applied to a liquid supply system that supplies ink to a liquid ejecting apparatus (liquid consuming apparatus), and may be used for various liquid consuming apparatuses that includes a liquid ejecting head for discharging small droplets. Meanwhile, the droplet means liquid that is discharged from the liquid ejecting apparatus, and includes granular liquid, tear-like liquid, and filamentous liquid with a tail. Further, the liquid, which has been described herein, may be a material that can be ejected by a liquid consuming apparatus. For example, a liquefied material may be used as the liquid. Examples of the liquid include a liquid material having high or low viscosity; fluid materials, such as sol, gel water, an inorganic solvent, an organic solvent, a solution, a liquid resin, and liquid metal (metal melt); and a mixture where particles of functional materials including solids such as pigments or metal particles are dissolved, dispersed, and mixed in a solvent as well as liquid that is one state of a material. Further, typical examples of liquids may include ink described in the embodiment and a liquid crystal. Herein, ink generally includes various liquid compositions, such as water-based ink, oil-based ink, gel ink, and hot melt ink. Specific examples of the liquid consuming apparatus may include a liquid ejecting apparatus that ejects the liquid where materials, such as electrode materials or color materials used to manufacture, for example, a liquid crystal display, an EL (electroluminescence) display, a surface-emitting display, a color filter, and the like, are dissolved or dispersed; a liquid ejecting apparatus that ejects bioorganic materials used to manufacture a biochip; a liquid ejecting apparatus that is used as a precision pipette and ejects sample liquid; a printing device; and a microdispenser. In addition, the above-mentioned ink supply system may be employed as supply systems of a liquid ejecting apparatus that ejects lubricant oil to a precision machine, such as a watch or a camera, by a pinpoint; a liquid ejecting apparatus that ejects transparent resin liquid such as an ultraviolet curable resin onto a substrate in order to form a small hemispherical lens (optical lens) or the like used for an optical communication device or the like; and a liquid ejecting apparatus that ejects etchant acid or alkali etchant to etch a substrate or the like. Further, the invention may be applied to the supply system of one of the ejecting apparatuses.

The embodiments and modifications of the invention have been described above. However, the invention is not limited to the embodiments and modifications, and may have various other embodiments without departing from the scope of the invention.

The entire disclosure of Japanese Patent Application No. 2008-202078, filed Aug. 5, 2008, is expressly incorporated by reference herein.

What is claimed is:

1. A liquid container configured to be mounted on a liquid ejecting apparatus when being used, the liquid container comprising:

a plurality of outer surfaces;

a liquid supply section that is connected to the liquid ejecting apparatus when the liquid container is mounted on the liquid ejecting apparatus;

a liquid storage chamber that is disposed on the upstream side of the liquid supply section and stores liquid;

an atmosphere introducing section that is disposed in the liquid storage chamber, and introduces atmosphere into the liquid storage chamber from the outside through an atmosphere opening port as the liquid stored in the liquid storage chamber is consumed; and a case where at least a part of the atmosphere introducing section, at least a part of liquid storage chamber, and the liquid supply section are formed;

wherein the atmosphere opening port is exposed to a first outer surface that has the largest area among the plurality of outer surfaces, and wherein the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface, one end of the first communication passage being connected to the atmosphere opening port and the other end thereof being connected to the second flow passage, one end of the second communication passage being connected to the first flow passage and the other end thereof being connected to the second flow passage, and an opening of the first flow passage facing the first outer surface being sealed by a first film and an opening of the second flow passage facing the second outer surface being sealed by a second film.

2. The liquid container according to claim 1, wherein the liquid container is packed by a packing member, an inner space of the packing member is decompressed, and a gap between an inner surface of the packing member and the atmosphere opening port is sealed by a pressing force that is applied to the packing member from the outside due to the atmospheric pressure, so that the atmosphere opening port is closed.

3. The liquid container according to claim 2, wherein a valve for opening and closing the atmosphere opening port is not provided at the atmosphere opening port, and a sealing member for blocking the atmosphere opening port is not provided at the atmosphere opening port.

4. The liquid container according to claim 1, wherein an outer edge portion of the atmosphere opening port protrudes outward from the first outer surface.

5. The liquid container according to claim 1, wherein a sealing member, which protrudes outward from the first outer surface, is provided at the outer edge portion of the atmosphere opening port.

6. The liquid container according to claim 5, wherein the sealing member is integrally formed with the case.

7. A packed liquid container comprising:

a container that is configured to be mounted on a liquid ejecting apparatus when being used; and a packing member that packs the container, wherein the container includes a plurality of outer surfaces, a liquid supply section that is configured to be connected to the liquid ejecting apparatus when the container is mounted on the liquid ejecting apparatus, a liquid storage chamber that is disposed on the upstream side of the liquid supply section and stores liquid, and an atmosphere introducing section that is disposed in the liquid storage chamber and introduces atmosphere into the liquid storage chamber from the outside through an atmosphere opening port as the liquid stored in the liquid storage chamber is consumed;

the packed liquid container further comprising a case where at least a part of the atmosphere introducing section, at least a part of the liquid storage chamber, and the liquid supply section are formed; wherein the atmosphere opening port is exposed to a first outer surface among the plurality of outer surfaces, an inner space of the packing member is decompressed, a gap between an inner surface of the packing member and the atmosphere opening port is sealed by a pressing force that is applied to the packing member from the outside due to the atmospheric pressure, so that the atmosphere opening port is closed, and the atmosphere introducing section includes a first flow passage that is formed in the shape of a groove on the side of the case facing the first outer surface, a second flow passage that is formed in the shape of a groove on the side of the case facing a second outer surface opposite to the first outer surface, and first and second communication passages that pass through the case from the first outer surface toward the second outer surface, one end of the first communication passage being connected to the atmosphere opening port and the other end thereof being connected to the second flow passage, one end of the second communication passage being connected to the first flow passage and the other end thereof being connected to the second flow passage, and an opening of the first flow passage facing the first outer surface being sealed by a first film and an opening of the second flow passage facing the second outer surface being sealed by a second film.

8. The packed liquid container according to claim 7, wherein a valve for opening and closing the atmosphere opening port is not provided at the atmosphere opening port, and a sealing member for blocking the atmosphere opening port is not provided at the atmosphere opening port.

9. The packed liquid container according to claim 7, wherein an outer edge portion of the atmosphere opening port protrudes outward from the first outer surface.

10. The packed liquid container according to claim 7, wherein a sealing member, which protrudes outward from the first outer surface, is provided at the outer edge portion of the atmosphere opening port.

11. The packed liquid container according to claim 10, wherein the sealing member is integrally formed with the case.

* * * * *